US011332960B2

(12) United States Patent
Schildwachter et al.

(10) Patent No.: US 11,332,960 B2
(45) Date of Patent: May 17, 2022

(54) ELECTRICALLY OPERATED DOOR STRIKE WITH THERMALLY RESPONSIVE ELEMENT

(71) Applicant: TRINE ACCESS TECHNOLOGY, Bethel, CT (US)

(72) Inventors: Fred H. Schildwachter, Johns Island, SC (US); Ferdinand E. Orbeta, Mount Kisco, NY (US)

(73) Assignee: TRINE ACCESS TECHNOLOGY, Bethel, CT (US)

( * ) Notice: Subject to any disclaimer, the term of this patent is extended or adjusted under 35 U.S.C. 154(b) by 551 days.

(21) Appl. No.: 16/222,454

(22) Filed: Dec. 17, 2018

(65) Prior Publication Data

US 2019/0226234 A1 Jul. 25, 2019

Related U.S. Application Data

(60) Provisional application No. 62/608,893, filed on Dec. 21, 2017.

(51) Int. Cl.
*E05B 65/10* (2006.01)
*E05B 47/00* (2006.01)
(Continued)

(52) U.S. Cl.
CPC ..... *E05B 65/104* (2013.01); *E05B 15/0205* (2013.01); *E05B 47/0047* (2013.01);
(Continued)

(58) Field of Classification Search
CPC ..... E05B 15/0205; E05B 15/022; E05B 47/0046; E05B 47/0047; E05B 47/0004;
(Continued)

(56) References Cited

U.S. PATENT DOCUMENTS 4,015,869 A 4/1977 Horvath
4,867,496 A * 9/1989 Thomas ..... E05B 47/0047 292/341.16

(Continued)

FOREIGN PATENT DOCUMENTS

CA 2538437 A1 * 9/2006 ..... E05B 65/104
DE 10321802 A1 12/2004

(Continued)

OTHER PUBLICATIONS

International Search Report and Written Opinion of the International Searching Authority for corresponding application PCT/US2018/066020 dated Mar. 4, 2019.

*Primary Examiner* — Kristina R Fulton
*Assistant Examiner* — Noah Horowitz
(74) *Attorney, Agent, or Firm* — Norris McLaughlin PA

(57) ABSTRACT

In one aspect the present invention provides a door strike which prevents the opening of an associated door when the door strike has been heated to an elevated temperature of at least about 1000° F., preferably when the door strike is at higher temperatures such as are present during a fire in a building structure. The door strike includes a thermally responsive element which retards the normal operation of the door strike when it is at an elevated temperature. A further aspect of the invention is a method for controlling the undesired spread of a fire or smoke between adjacent spaces separated by the door wherein a fire or smoke condition exists in at least one of these spaces, via the provision of a door strike having a thermally responsive element which retards the normal operation of the door strike when it is at an elevated temperature.

11 Claims, 5 Drawing Sheets

(51) Int. Cl.
*E05B 51/00* (2006.01)
*E05B 15/02* (2006.01)
*E05B 51/02* (2006.01)

(52) U.S. Cl.
CPC ..... *E05B 51/005* (2013.01); *E05B 47/0004* (2013.01); *E05B 51/02* (2013.01)

(58) Field of Classification Search
CPC .... E05B 65/104; E05B 51/005; Y10T 292/68; Y10T 292/696; Y10T 292/699; Y10T 292/702; Y10S 292/65; Y10S 292/66
See application file for complete search history.

(56) References Cited

U.S. PATENT DOCUMENTS

| | | | | |
|---|---|---|---|---|
| 5,492,208 | A * | 2/1996 | Goossens | E06B 5/164 292/66 |
| 5,782,509 | A | 7/1998 | Kiuyeda | |
| 8,132,833 | B2 * | 3/2012 | Schnekenburger | G08B 17/06 292/341.16 |
| 8,366,160 | B2 * | 2/2013 | Orbeta | E05B 47/0047 292/341.16 |
| 8,814,231 | B2 * | 8/2014 | Gandhi | E05B 77/42 292/336.3 |

FOREIGN PATENT DOCUMENTS

| | | | | |
|---|---|---|---|---|
| DE | 102005009995 | A1 * | 9/2006 | E05B 65/104 |
| DE | 102005009995 | A1 | 9/2006 | |
| FR | 2227759 | | 11/1974 | |
| WO | WO-2004101922 | A1 * | 11/2004 | E05B 47/0047 |
| WO | 2019126045 | A1 | 6/2019 | |

* cited by examiner

ELECTRICALLY OPERATED DOOR STRIKE WITH THERMALLY RESPONSIVE ELEMENT

The invention relates to a door strike used to prevent the opening of an associated door when the door strike has been heated to an elevated temperature. More particularly the door strike incorporates a thermally responsive element within its construction which, in response to a being at a temperature of at least about 1000° F. operates to incapacitate the associated door from being opened in its usual manner. In a preferred embodiment the door strike is an electrically operated door strike, but may be used in other configurations of locking hardware.

In general, prior art strikes comprise a single solenoid which has a winding of a conductor which, when electrically energized, actuates an armature which has a locking member connected thereto and biased by a spring so that the locking member prevents pivoting of the keeper unless the solenoid is electrically energized. To keep the energizing current low, the biasing spring usually has a force which is only slightly more than the force required to return the locking member and the armature to their locking or unlocking positions. It is also known in the art to use an air actuated piston and cylinder assembly with the piston connected to the locking member to actuate the locking member.

In conditions when a fire is present in a building, it may be advantageous to have a feature wherein doors which are exposed to elevated temperature conditions are automatically held in a locked condition as such may be used to retard the spread of a fire, particularly between adjacent spaces separated by the door. Where a fire condition exists in one of these spaces (i.e., a room, chamber, hallway at the like) and entry into this space would be hazardous due to a fire or smoke conditions being present in that space, inadvertent entry into that space is retarded by holding the door separating these spaces in a locked condition, even if a solenoid (or air actuated piston and cylinder assembly) is actuated. Such a feature would aid in containing the fire and/or smoke condition separate from the adjacent spaces where a fire and/or smoke condition does not exist, the latter would be a safe space for occupants of the building who should seek a rapid entry from the building. It would also be advantageous that such a feature would also be a reversible feature, that is to say that when the elevated temperature ceases to exist in the building then, the door could be opened in its usual manner; in particular that the actuation of the solenoid (or air actuated piston and cylinder assembly) of the door strike would permit for the associated door to be opened.

Door strikes which are responsive to thermal conditions are known to the art. For example in U.S. Pat. No. 8,132,833 to Schneckenburger is disclosed a door strike apparatus which includes an intumescent material, which relies upon a chemical change in the material upon exposure to high heat. Upon exposure of the door strike apparatus to an elevated temperature, the intumescent material is heated and expands to a larger volume which acts to fill internal voids present within the door strike apparatus and between certain of the moving parts thereof which incapacitates the door strike apparatus from a normal mode of operation. The use of the intumescent material is not reversible in operation, namely in order to restore the door strike apparatus to its usual mode of operation the door strike apparatus is necessarily removed, disassembled, cleaned, reassembled and reinstalled into the door frame.

The present invention addresses and overcomes various shortcomings in the prior art.

Figure 1:
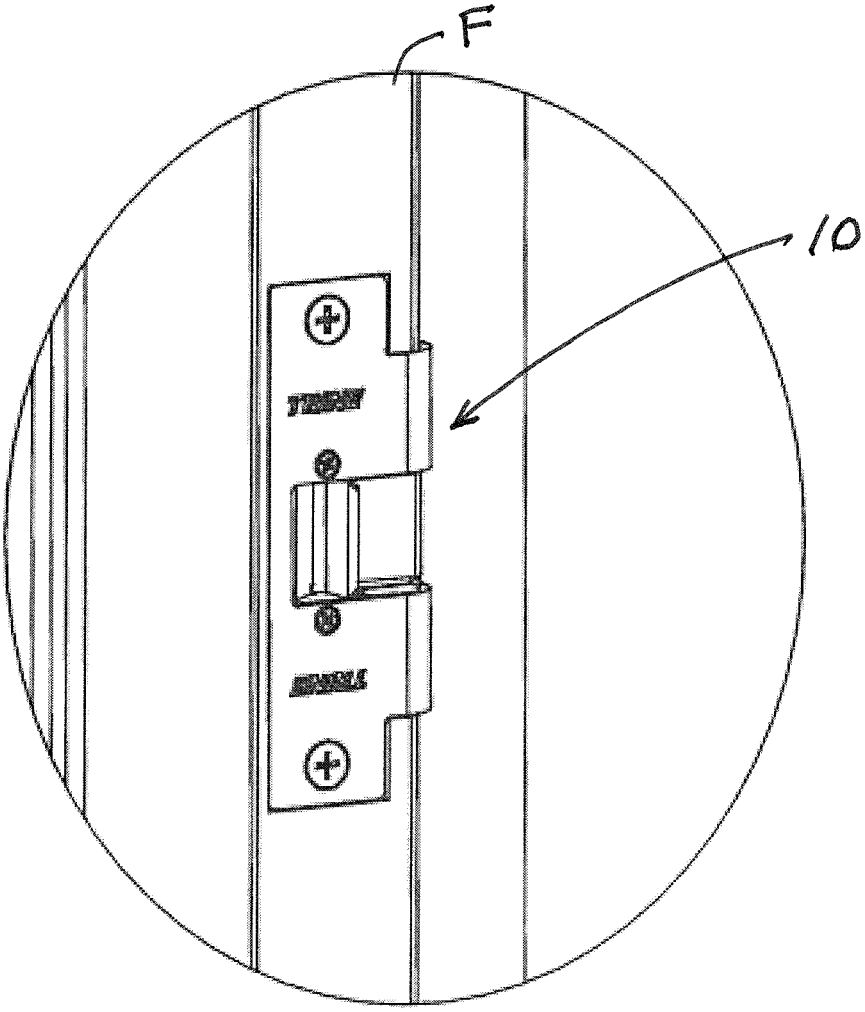
FIG. 1 depicts an embodiment of a door strike of the invention installed within a part of a door frame.

In a first aspect of the present invention there is provided locking hardware which prevents the opening of an associated door when the locking hardware has been heated to an elevated temperature of at least about 1000° F., preferably when the door strike is at higher temperatures such as are present during a fire in a building structure.

In a second aspect of the present invention there is provided a door strike, preferably an electrically operable door strike, which prevents the opening of an associated door when the door strike has been heated to an elevated temperature of at least about 1000° F., preferably when the door strike is at higher temperatures such as are present during a fire in a building structure.

In a third aspect, there is provided locking hardware of the first aspect, or a door strike of the second embodiment, wherein the locking hardware and/or door strike is operable in a reversible manner, namely when the locking hardware and/or door strike is exposed to an elevated temperature (e.g., 1000° F. or higher) it prevents its associated door from opening while the elevated temperature condition exists, even if the actuating mechanism (i.e., a solenoid, or air actuated piston and cylinder assembly) is operated or engaged, but when the elevated temperature of the locking hardware and/or door strike is diminished and the elevated temperature condition of the door strike ceases to exist then, the associated door may be opened in its usual manner, viz the actuation of the solenoid (or air actuated piston and cylinder assembly) of the locking hardware and/or door strike permits for the associated door to be opened.

In a fourth aspect of the invention there is provided a method for controlling the undesired spread of a fire or smoke between adjacent spaces separated by the door wherein a fire or smoke condition exists in at least one of these spaces, the method comprising the step of providing a locking hardware and/or door strike according to any of the foregoing aspects of the invention for use with the door.

These and further aspects and features of the present invention will be described in further detail in the following description of which the drawing figures form an integral part thereof.

In the drawing figures, like elements are identified by common reference numerals and/or letters within the several drawing figures. References to elements of the door strike are to be understood as being also relevant to locking hardware which is not necessarily part of a door strike for use with doors, but which may be used with other openable parts or structures, e.g., windows, panels, etc.

Referring generally now to the drawings, FIG. 1 illustrates an embodiment of a door strike 10 of the invention installed within a part of a door frame F in which an associated door is also present (although not illustrated in the drawing figure.). It is readily understood that the door includes a lockset (not shown) which interacts with the spring biased keeper 4 present in the support frame 6.

Figure 2:
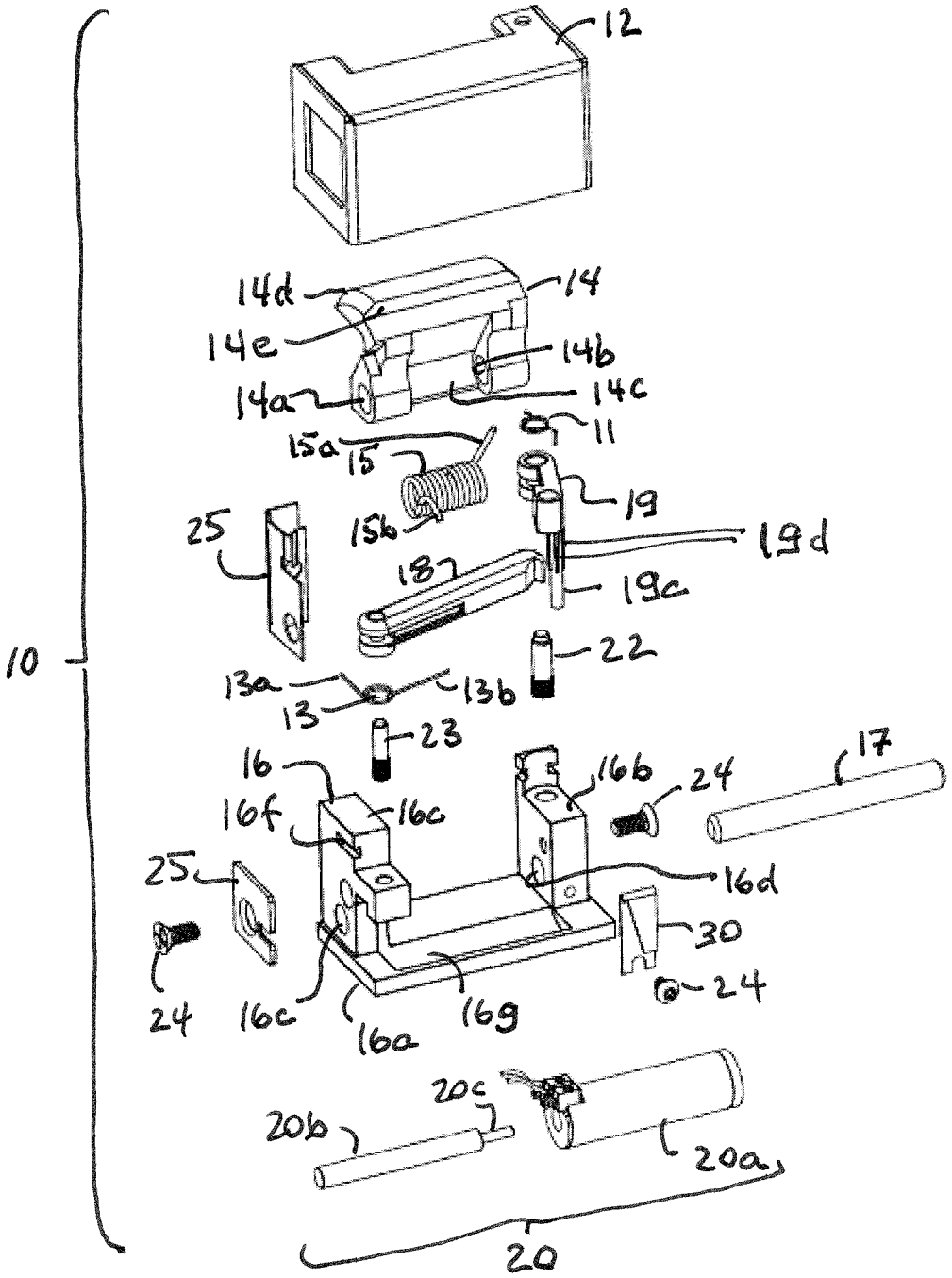
FIG. 2 depicts in an exploded view the interior of an electrically operable embodiment of a door strike including certain component parts thereof.

FIG. 2 depicts in an exploded view the interior of an electrically operable embodiment of a door strike 10 illustrating various component parts thereof, including the thermally responsive element. As is seen in the figure the keeper 14 is mounted to a frame 16 via a rod 17 which passes through one or more bores 14*a*, 14*b* present in the keeper 14. A recess 14*c* is provided within which a keeper spring 15 is present which is also mounted upon the rod 17; two ends of the keeper spring 15*a*, 15*b* extend from the keeper spring 15, the former contacting a part of the keeper 14, the latter contacting a further part of the door strike 10, here a part of the solenoid coil 20*a* of the solenoid 20. The frame 16 includes a base section 16*a* and two spaced apart, upstanding wall sections 16*b*, 16*c*. The keeper 14, is pivotably mounted upon the rod 17 and both may be retained between spaced apart support walls 16*b*, 16*c* with the rod 17 passing through suitable bores 16*d*. 16*e* which receive the rod 7 when the keeper 4 is positioned therebetween. The frame 16 further includes in its base section 16*a* a retention cavity 16*g* which is configured to receive the solenoid 20. When mounted as described and depicted, the keeper 14 is pivotably mounted within the frame 16 and about the rod 17, the keeper spring 15 exerts a biasing force upon the keeper 14 when the solenoid coil 20*a* is not energized such that the lip 14*d* which comes into engagement with a part of the lockset (not shown), the force of the keeper spring 15 maintains the door strike 10 in a first, locked position (as per FIGS. 3, 4) which keeps the door in a closed position with respect to the door frame F.

Further visible is a biased locking lever 19 including a latch section 19*f* which interacts with a long arm 18 having a latch hook end 18*a*. The locking lever 19 includes a pivot bore 19*a* at one end thereof and at the opposite end thereof a pin bore end 19*b* within which is mounted a locking shaft 19*c*. The locking lever 19 is rotatably mounted upon a part of support wall 16*b* via a pivot pin 22 which passes through the pivot bore 19*a* of the locking lever 19. Advantageously the pivot pin 22 also engages a part of the locking lever spring 11 which biases the locking lever 17 to pivot towards the solenoid 20 and inwardly towards the keeper 14. When the solenoid rod 20*b* is caused to move outwardly from the interior of the solenoid coil 20*a* when it is energized, a solenoid rod end 20*c* contacts the locking shaft 19*c* causing it to move away from the solenoid coil 20*a* as well as the keeper 14 against the bias of the locking lever spring 11 by concurrently pivoting the locking lever 19. When the solenoid coil 20*a* is de-energized the solenoid rod 20*c* is retracted into the solenoid coil 20*a*, and the force of the locking lever spring 11 returns the locking lever 19 to its prior "locked" position as is more clearly seen in FIGS. 3 and 4. In its locked position, the latch hook end 18*a* of the long arm 18 engages a part of the locking lever 19, in particular the latch section 19*a*. A sloped wall surface 19*e* present within the latch section 19*f* is contacted by a correspondingly shaped surface of the latch hook end 18*a* when the solenoid coil 20*a* is in a de-energized state. Distally positioned from the latch hook end 18*a* of the long arm 18 is a latch hook bore 18*b* through which a further pivot pin 23 extends. The further pivot pin 23 is used to rotatably mount the long arm 18 to the upstanding wall 16*c*. A long arm bias spring 13 having two ends 13*a*, 13*b* is also present and mounted about the further pivot pin 23, with one end 13*a* positioned in a receiving groove 16*f* within the upstanding wall 16*c*, and the other end 13*b* contacting a part of the lone arm 18. The long arm bias spring 13 is positioned to urge the long arm 18 to pivot towards the keeper 14, such that the long arm 18 is positioned within a locking channel 14*e* forming part of the keeper 14 such that in in said position the keeper 14 is "locked" and unable to sufficiently pivot about the rod 17 and permit for the door to be opened. However, when the solenoid coil 20*a* of the solenoid assembly 20 is energized to allow for the door strike 10 to be in an "opened" state, the solenoid rod 20*b* extends outwardly from the solenoid coil 20*a* such that the solenoid rod end 20*c* contacts and pushes the locking shaft 19*c* away from the keeper 14 causing it to sufficiently pivot to thereby disengage from and release the latch hook end 18*a* from the latch section 19*f* and consequently permitting for the displacement of the long arm 18 and to allow it to pivot away from the keeper 14 when pressure upon the lip 14*d* of the keeper 14 causes it to rotate or pivot about the shaft 17. Such permits for the door associated with the door strike 10 to be opened and then swung in the door frame F disengaging the door lockset from the door strike assembly 10. However when the solenoid assembly 20 is de-energized, the biasing forces of the keeper spring 15, the long arm bias spring 13 and the locking lever spring 11 urge elements of the lock strike assembly 10 to return to a "locked" state.

The door strike 10 may includes further elements useful in assembly and retaining parts thereof such as fasteners 24 which may be screws as depicted, but which may be other fasteners providing a similar function, i.e., pins, rivets or adhesives, as well as supporting plates 25 and an assembly cover 12 which may advantageously be used to encase one or more elements of the door strike 10. Advantageously the assembly cover 12 obscures the long arm 18 and the locking lever 19 from view and retards easy access to these elements so to diminish tampering or interference with the operation of these elements. Such an anti-tampering benefit enhances the overall reliability of the electrically operable door strike at all thermal conditions.

Figure 3:
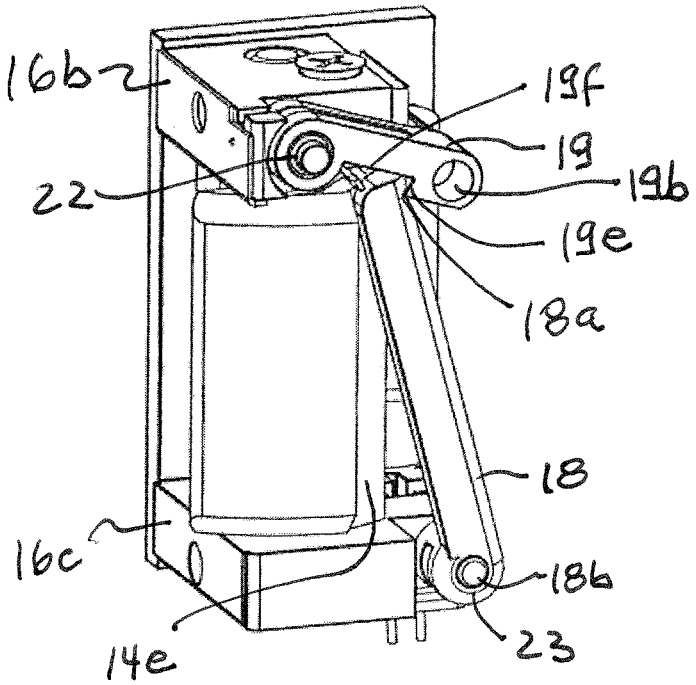
FIG. 3 depicts a door strike in an "upright" configuration.
Figure 4:
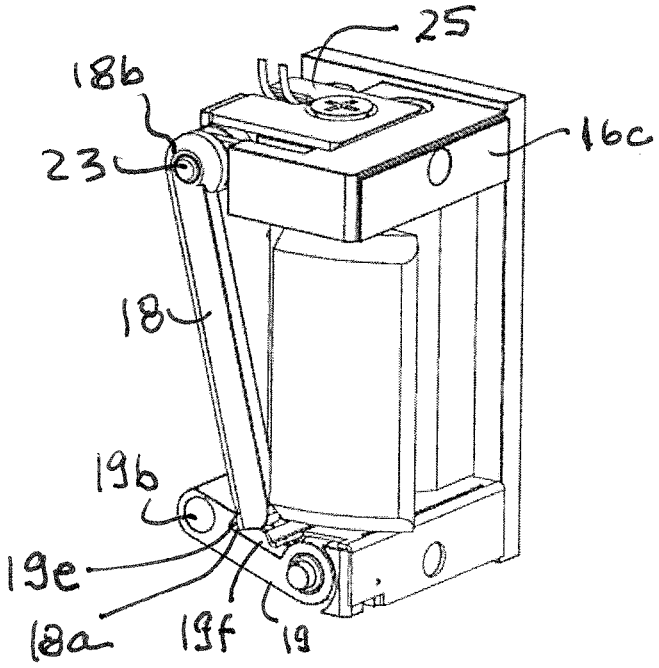
FIG. 4 depicts a door strike in an "inverted" configuration.

The door strike 10 may be installed in a left hand door configuration or a right hand door configuration, as the door strike 10 is effective in both an "upright" configuration as per FIG. 3, or in an "inverted" configuration as per FIG. 4, without any detriment to its operation.

Figure 5A:
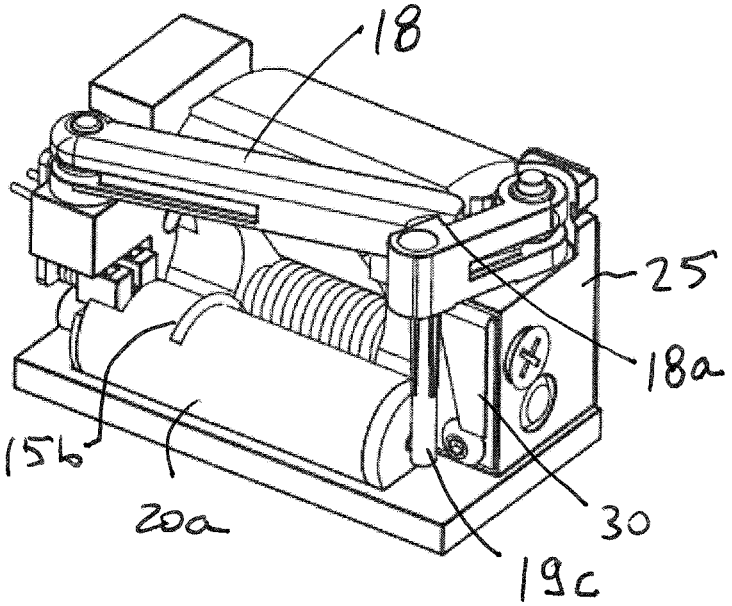
FIG. 5A depicts a side view of an end of the electrically operable door strike at room temperature.

FIG. 5A depicts a further side view of an end of the electrically operable door strike assembly 10 of FIGS. 2, 3, and 4 which shows in greater detail the thermally responsive element 30. Before further discussing this preferred, albeit non-limiting, embodiment of the door strike assembly 10 depicted in the drawing figures, (and associated methods of using the same) a brief discussion of the thermally responsive element is warranted. The thermally responsive element is deformable in response to being heated such that it changes its configuration from a first configuration to a second configuration, when heated to elevated temperatures, such that in this second configuration at least part of the thermally responsive element interacts with one or more further elements of the electrically operable door strike so to prevent or retard the electrically operable door strike from operating in its usual manner, thereby retarding or denying the associated door from being opened in its usual manner, i.e., by pushing or pulling the door. In a particularly preferred embodiment the thermally responsive element, when in its heated configuration, interferes with one or more mechanically displaceable elements of the door strike such that even if an internal solenoid, or actuated piston and cylinder assembly is operated, the door strike remains in its locked state. Only when the thermally responsive element has been sufficiently cooled from a heated or elevated temperature, it may revert back to its first configuration and thereby permit the electrically operable door strike to operate in its usual manner.

In a certain embodiment of the invention the thermally responsive element is irreversibly deformable, such that when heated to an elevated temperature and assumes a second configuration, it does not revert to its first, initial configuration when cooled. i.e., to about room temperature (about 68° F. (20° C.)). Preferably however the thermally responsive element is reversibly deformable, that is to say it assumes a second configuration when heated to an elevated temperature from its first configuration, i.e. an initial configuration when the thermally responsive element is at about room temperature, but when cooled from the elevated temperature to about room temperature it substantially reverts to its first configuration. While an elevated temperature may be any which is above about room temperature, preferably such an elevated temperature is a temperature of at least about 1000° F. (538° C.), preferably at least about 1200° F. (649° C.), still more preferably at least about 1400° F. (760° C.) or even higher. The change in configuration of the thermally responsive element from the initial or first configuration to its heated or second configuration, causes at least part of the a thermally responsive element to interact with one or more further parts of the door strike, preferably the electrically operated door strike so to prevent or retard the door strike from operating in its usual manner, thereby retarding or denying the associated door from being opened in its usual manner, i.e., by pushing or pulling the door.

In a particularly preferred embodiment the thermally responsive element, when in its heated configuration, interferes with one or more mechanically displaceable elements of the door strike such that even if an internal solenoid, (or actuated piston and cylinder assembly is operated, the door strike remains in its locked state.) Only when the thermally responsive element has been sufficiently cooled from a heated or elevated temperature, it may revert back to its first configuration and thereby permit the electrically operable door strike to operate in its usual manner.

Returning now to FIG. 5A and FIG. 5B, which latter figures illustrates an elevational end view of the electrically operable door strike assembly 10, the thermally responsive element 30 is visible in a first configuration corresponding to a condition wherein the door strike 10 is at about room temperature. As is seen the element 30 is a U-shaped strip having a first leg 30*a* which is affixed to a part of the frame 16, by a fastener 30, a second leg 30*b* which is substantially parallel to the first leg 30*a* and an intermediate bow part 30*c*. As is most clearly visible from FIG. 5B, in its first configuration the thermally responsive element 30 is in a folded configuration and is configured such that no part of it impedes the function of any other element of the door strike 10.

Figure 5B:
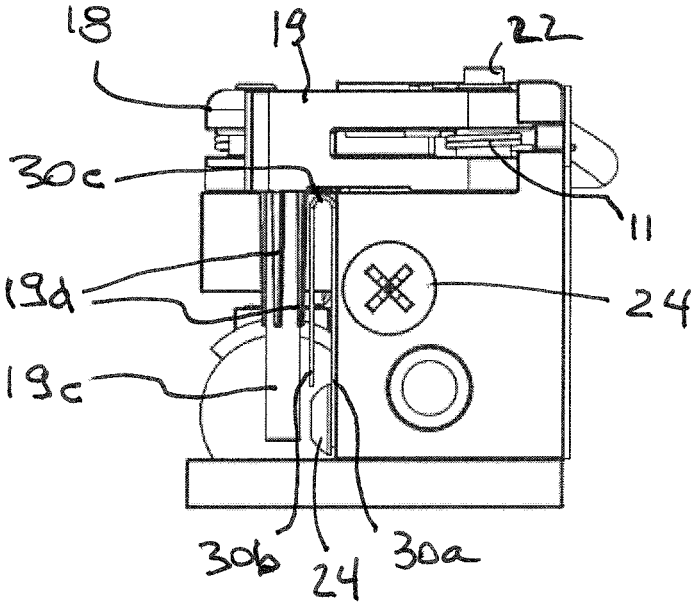
FIG. 5B depicts an elevational end view of the electrically operable door strike assembly of FIG. 5A.
Figure 6A:
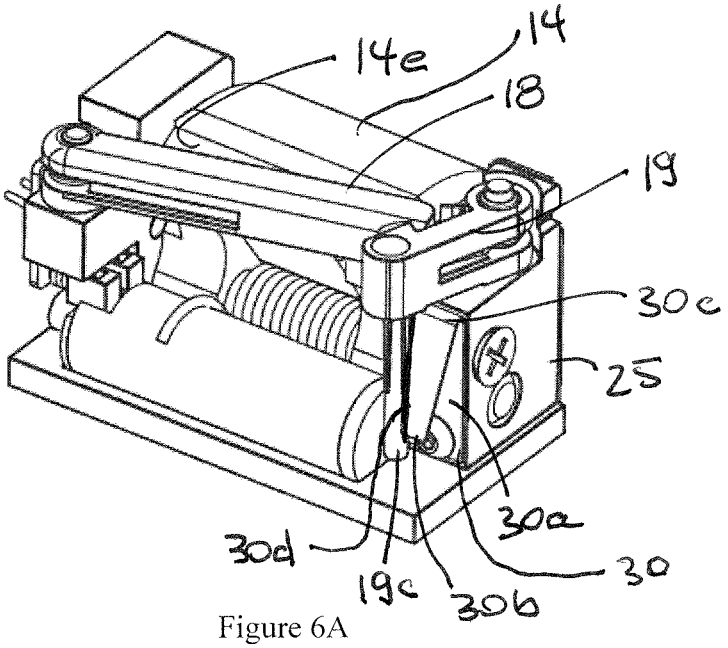
FIG. 6A depicts the view of the door strike of FIG. 5A but at an elevated temperature.
Figure 6B:
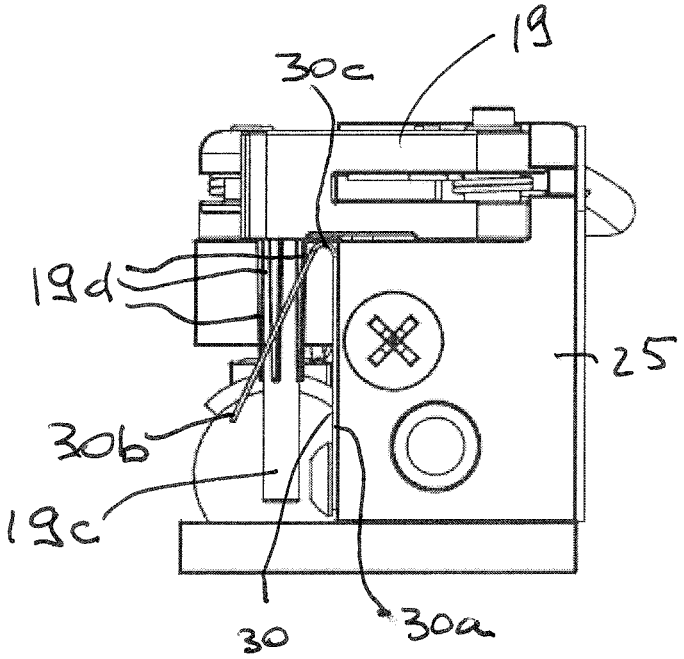
FIG. 6B depicts an elevational end view of the electrically operable door strike assembly of FIG. 6A, at the elevated temperature.

FIGS. 6A and 6B correspond with FIGS. 5A and 5B but illustrate the door strike 10 at an elevated temperature, and the thermally responsive element 30 also at an elevated temperature wherein it has assumed a second configuration. As is seen from these figures the second leg 30*b* extends outwardly from the first leg 30*a* and extends into the path of the locking shaft 19*c* of the locking lever 19. In this second configuration the second leg 30*b* thus inhibits the motion of the locking lever 19 when an elevated temperature is present and maintains the second configuration of the thermally responsive element 30. Such thus denies the movement not only of the locking lever 19 but also of the engaged long lever 18 and the keeper 14 while elevated temperatures persist. Such denies the operation of the keeper 14 and the opening of the associated door even if the solenoid coil 20*a* is energized.

As is most readily seen from FIG. 6A the thermally responsive element 30 may include a tapered edge 30*d* of the second leg 30*b* which comes into contact with part of the locking shaft 19*c*. Optionally but preferably parts of the locking shaft 19*c* included one or more tapered ribs 19*d* extending outwardly from the locking shaft 19*c* which provided an improved interference type fit with the second leg 30*b*, particularly if it includes a tapered edge 30*d*.

As noted previously the thermally responsive element 30 may operate in a reversible manner, or it may operate in an irreversible manner. In the former the thermally responsive element 30 ultimately reverts to its first configuration from its second configuration when cooled, e.g. to about room temperature (approx. 68° F.). In this manner, the thermally responsive element 30 undergoes reversible deformation due to being heated to the elevated temperature, and thereafter being cooled to about room temperature. In the latter the thermally responsive element 30 changes from its first configuration and assumes a second configuration when heated to an elevated temperature, but does not revert to its first configuration when cooled, e.g. to about room temperature. In this manner, the thermally responsive element 30 undergoes permanent deformation due to being heated to the elevated temperature. The latter, i.e., permanently deformed thermally responsive element 30 would require that the door strike 10 be removed and the thermally responsive element 30 replaced with a new such element and the door strike 10 reinstalled before allowing the associated door to be returned to normal usage.

Any material of construction which responds in the manner discussed above may be used in the fabrication of a suitable thermally responsive element 30. Preferably the thermally responsive element 30 incorporates into its construction a thermally responsive metal element which would provide such an operation as described. Bi-metallic elements are advantageously used as or forming parts of thermally responsive elements, it only being require that they respond to elevated temperatures as described herein. A non-limiting example of such a thermally responsive metal include those sold as "Polymet" materials (ex. Precision Engineered Products, 262 Broad Street, North Attleboro, Mass. 02760). An example of such a material is "Polymet 258" which is a metal alloy having a (nominal) composition of 25% wt. Ni, 8.5% wt. Cr and the remaining balance being substantially Fe. Other metal alloys may be used, included for example (and without limitation): (i) 18% wt. Ni, 11.5% wt. Cr with the remaining balance being substantially Fe; (ii) 19.4% wt. Ni, 2.25% wt. Cr, 0.5% wt C, with the remaining balance being substantially Fe; (iii) 22% wt. Ni, 3% wt. Cr, with the remaining balance being substantially Fe; (iv) 70% wt. Cu, 30% wt. Zn; (v) 72% wt. Mn, 18% wt. Cu, 10% wt. Ni; (vi) 5% wt. Sn, 0.3% wt. Zn, with the remaining balance substantially Cu; (vii) Cu; (viii) 1008 AK Steel; (ix) Ni; (x) 36% wt. Ni, with the remaining balance substantially Fe (INVAR); (xi) 40% wt. Ni, with the remaining balance substantially Fe; (xii) 42% wt. Ni, with the remaining balance substantially Fe; (xiii) 45% wt. Ni, with the remaining balance substantially Fe; (xiv) 50% wt. Ni, with the remaining balance substantially Fe; (xv) 38.6536% wt. Ni, with the remaining balance substantially Fe; and (xvi) 17% wt. Cr, with the remaining balance substantially Fe. Such are commercially available as other grades of "POLYMET" materials. The thermally responsive element 30 may be substantially fabricated of such a metal alloy or only a part thereof, e.g., the intermediate bow part 30*c* thereof, optionally with part of leg 30*b*. The thermally responsive element 30 may include such a thermally responsive metal in part of its construction but may include further non-thermally responsive materials which may be metals, polymers, or other non-thermally responsive materials. The thermally responsive element 30 may also be of a different configuration than that illustrated in the drawing figures.

It is to be understood that the drawings depict a preferred embodiment the invention but such is not to be considered a limiting disclosure and that various modifications are possible and readily foreseen and also that such fall within the scope of the present invention. Thus the drawing figures are to be understood as non-limiting as to the scope of the present inventive teaching. One such modification is the use of an air actuated piston and cylinder assembly in place of the electrically operable solenoid depicted in the drawing figures as the provision of the thermally responsive element would be equally effective regardless of the actuation means of the door strike of with the thermally responsive element forms a part.

Provision of a door strike assembly as described herein is useful in a method for controlling the undesired spread of a fire or smoke between adjacent spaces separated by the door wherein a fire or smoke condition exists in at least one of these spaces, as it facilitates in a door associated with a door strike of the present invention from being opened when the door and its electrically operable door strike are exposed to a fire. Such a method ensures that occupants present within a building or structure do not open doors within the building in which a fire is present when the door strike and its thermally responsive element are at an elevated temperature. Such may improve the safety of the occupants of the building under such conditions, as denying opening of doors between parts of the building which are relatively safe from those parts of the building in which is fire is present. Such retards the unwanted spread of a fire from the latter to the former parts of the building. Such also retards the unwanted spread of smoke from parts of the building in which fire is present to parts of the building in which smoke and/or fire is not present.

And electrically operable door strike and its thermally responsive element may fabricated to provide a very small electrically operable door strike having a relatively compact size as compared to other electrically operable door strike known to the prior art.

The invention claimed is:

1. A door strike which prevents the opening of an associated door when the door strike has been heated to elevated temperatures which are present during a fire in a building structure, wherein the door strike includes:

a pivotable keeper positioned between two upstanding walls, a latch section which includes a biased locking lever which interacts with a long arm which interacts with the keeper, the biased locking lever being pivotable with respect to one of the upstanding walls and includes a locking shaft extending therefrom, which biased locking lever is moveable responsive to the extension of a solenoid rod from a solenoid coil present within the door strike when the solenoid coil is energized contacting the locking shaft, and a foldable thermally responsive element which retards the normal operation of the door strike when it is at an elevated temperature by contacting and interfering with pivoting of biased locking lever and movement of the locking shaft causing the door strike to remain in a locked state.

2. A door strike of claim 1, wherein the thermally responsive element is deformable in response to being heated such that it changes its configuration from a folded, first configuration to an unfolded, second configuration, when heated to the elevated temperature, such that in this second configuration at least part of the thermally responsive element interacts with the locking shaft of the door strike.

3. The door strike of claim 1, wherein the thermally responsive element operates in a reversible manner, wherein the thermally responsive element reverts to its folded, first configuration from its unfolded, second configuration when cooled to about room temperature.

4. The door strike of claim 1, wherein the thermally responsive element operates in an irreversible manner, wherein the thermally responsive element changes from its folded, first configuration and assumes a unfolded, second configuration when heated to an elevated temperature, but does not revert to its folded, first configuration when cooled to about room temperature.

5. A method of controlling the undesired spread of a fire or smoke between adjacent spaces separated by the door wherein a fire or smoke condition exists in at least one of these spaces, via the provision of a door strike or locking hardware according to claim 1.

6. The door strike of claim 1, wherein the thermally responsive element is a U-shaped strip having a first leg, connected via an intermediate bow part to a second leg which is substantially parallel to the first leg.

7. The door strike of claim 6, wherein the first leg is connected to a part of a frame of the door strike.

8. The door strike of claim 6, when at an elevated temperature such as is present during a fire in a building structure, the thermally responsive element is in a second configuration wherein the second leg is in an outwardly extended, non-parallel position with respect to the first leg, and the second leg inhibits the operation of the latch section while the elevated temperature persists.

9. The door strike of claim 1 wherein the elevated temperature is at least 1000° F.

10. The door strike of claim 9 wherein the elevated temperature is at least 1200° F.

11. The door strike of claim 10 wherein the elevated temperature is at least 1400° F.

* * * * *